US010753212B2

(12) United States Patent
Song

(10) Patent No.: US 10,753,212 B2
(45) Date of Patent: Aug. 25, 2020

(54) TURBINE BLADE, TURBINE, AND GAS TURBINE HAVING THE SAME

(71) Applicant: DOOSAN HEAVY INDUSTRIES & CONSTRUCTION CO., LTD., Changwon-si, Gyeongsangnam-do (KR)

(72) Inventor: Jin Woo Song, Changwon-si (KR)

(73) Assignee: Doosan Heavy Industries & Construction Co., Ltd, Gyeongsangnam-do (KR)

( * ) Notice: Subject to any disclaimer, the term of this patent is extended or adjusted under 35 U.S.C. 154(b) by 221 days.

(21) Appl. No.: 16/030,831

(22) Filed: Jul. 9, 2018

(65) Prior Publication Data

US 2019/0063235 A1 Feb. 28, 2019

(30) Foreign Application Priority Data

Aug. 23, 2017 (KR) ..... 10-2017-0106634

(51) Int. Cl.

| | |
|---|---|
| ***F01D 11/00*** | (2006.01) |
| ***F01D 5/30*** | (2006.01) |
| ***F01D 5/14*** | (2006.01) |
| *F01D 5/18* | (2006.01) |

(52) U.S. Cl.

CPC ..... *F01D 5/3023* (2013.01); *F01D 5/141* (2013.01); *F01D 5/147* (2013.01); *F01D 11/008* (2013.01); *F01D 5/186* (2013.01); *F05D 2220/32* (2013.01); *F05D 2230/51* (2013.01); *F05D 2250/75* (2013.01)

(58) Field of Classification Search

CPC ..... F01D 5/3023; F01D 5/141; F01D 5/147; F01D 5/186; F05D 2250/75; F05D 2230/51; F05D 2220/32; F05D 5/3023; F05D 2240/80

USPC ..... 416/204 R

See application file for complete search history.

(56) References Cited

U.S. PATENT DOCUMENTS

| | | | | |
|---|---|---|---|---|
| 5,244,345 | A * | 9/1993 | Curtis | F01D 5/22 416/95 |
| 5,277,548 | A * | 1/1994 | Klein | F01D 11/008 29/889.21 |
| 6,190,131 | B1 * | 2/2001 | Deallenbach | F01D 5/027 416/144 |
| 7,594,799 | B2 * | 9/2009 | Miller | F01D 5/147 416/219 R |
| 10,508,557 | B2 * | 12/2019 | Jung | F01D 5/3015 |

(Continued)

*Primary Examiner* — J. Todd Newton

(74) *Attorney, Agent, or Firm* — Invenstone Patent, LLC

(57) ABSTRACT

A turbine blade, installed on a rotor disk of a turbine and configured to rotate the turbine by a force of flowing gas, includes a root configured to be coupled to the rotor disk; a platform integrally formed with an upper portion of the root, the platform having opposite sides respectively extending in an axial direction of the rotor disk; an airfoil integrally formed with an upper portion of the platform; and an angel wing configured to be removably coupled to each of the opposite sides of the platform. When coupled, the angel wing protrudes from the platform in the axial direction. The turbine blade, which may be included in the turbine of a gas turbine, is capable of improving the castability and adjusting a clearance between an airfoil and a turbine rotor disk such that space between the airfoil and the turbine rotor disk can be reliably sealed.

18 Claims, 8 Drawing Sheets

(56) References Cited

U.S. PATENT DOCUMENTS

2004/0126239 A1* 7/2004 Gautreau ..... F01D 5/16 416/220 R
2005/0232777 A1* 10/2005 Gautreau ..... F04D 29/668 416/219 R
2010/0172760 A1* 7/2010 Ammann ..... F01D 5/3015 416/179
2012/0049467 A1* 3/2012 Stewart ..... F01D 11/006 277/641
2012/0082550 A1* 4/2012 Harris, Jr. ..... F01D 5/186 416/95
2012/0156045 A1* 6/2012 Ammann ..... F01D 5/3007 416/219 R
2013/0115103 A1* 5/2013 Dutta ..... F01D 5/186 416/97 R
2013/0272880 A1* 10/2013 Boeck ..... F01D 5/141 416/95
2014/0301838 A1* 10/2014 Lovelace ..... F01D 5/005 415/208.2
2014/0301850 A1* 10/2014 Garcia Crespo ..... F01D 5/081 416/193 A
2015/0010404 A1* 1/2015 Le Hong ..... F01D 5/3023 416/220 R
2015/0064018 A1* 3/2015 Ahmad ..... F01D 11/008 416/90 R
2016/0123169 A1* 5/2016 Ruggiero ..... F01D 25/12 415/173.7
2016/0153304 A1* 6/2016 Aggarwala ..... F01D 5/22 416/185
2016/0215626 A1* 7/2016 Chouhan ..... F01D 5/081
2016/0222800 A1* 8/2016 Kleinow ..... F01D 5/147
2016/0245107 A1* 8/2016 Dungs ..... F01D 5/225
2016/0326879 A1* 11/2016 Chouhan ..... F01D 5/082
2016/0326889 A1* 11/2016 Chouhan ..... F01D 11/001
2016/0348525 A1* 12/2016 Thornton ..... F01D 11/005
2017/0175557 A1* 6/2017 Chouhan ..... F01D 9/041
2018/0112543 A1* 4/2018 Thomas ..... F01D 9/02
2018/0216467 A1* 8/2018 Corsetti ..... F04D 29/083
2018/0223683 A1* 8/2018 Tham ..... F01D 11/001
2018/0230828 A1* 8/2018 Zemitis ..... F01D 5/3007
2018/0230829 A1* 8/2018 Zemitis ..... F01D 5/3015
2019/0063235 A1* 2/2019 Song ..... F01D 5/141
2019/0078454 A1* 3/2019 Rudolph ..... F01D 11/006
2019/0301295 A1* 10/2019 Hernandez ..... F01D 11/008
2020/0072063 A1* 3/2020 Sippel ..... F01D 5/3069
2020/0095874 A1* 3/2020 Freeman ..... F01D 5/3015
2020/0095875 A1* 3/2020 Sippel ..... F01D 5/326

* cited by examiner

TURBINE BLADE, TURBINE, AND GAS TURBINE HAVING THE SAME

CROSS-REFERENCE TO RELATED APPLICATIONS

This application claims priority to Korean Patent Application No. 10-2017-0106634, filed on Aug. 23, 2017, the disclosure of which is incorporated herein by reference in its entirety.

BACKGROUND OF THE DISCLOSURE

Field of the Disclosure

Exemplary embodiments of the present disclosure relate to a turbine blade configured to rotate a turbine using pressure generated when high-temperature and high-pressure gas is discharged, and a turbine and a gas turbine having the same.

Description of the Related Art

A turbine is a machine which generates rotating force from impulsive force or reaction force using the flow of compressive fluid such as steam or gas. The turbine is classified into a steam turbine using steam, a gas turbine using high-temperature combustion gas, and so forth.

The gas turbine chiefly includes a compressor, a combustor, and a turbine. The compressor includes an air inlet into which air is introduced, and a plurality of compressor vanes and a plurality of compressor blades which are alternately provided in a compressor casing.

The combustor is configured to supply fuel into air compressed by the compressor and ignite the fuel mixture using a burner, thus generating high-temperature and high-pressure combustion gas.

The turbine includes a plurality of turbine vanes and a plurality of turbine blades which are alternately arranged in a turbine casing. Furthermore, a rotor is disposed passing through central portions of the compressor, the combustor, the turbine, and an exhaust chamber.

Opposite ends of the rotor are rotatably supported by bearings. A plurality of disks are fixed to the rotor, and the blades are coupled to the corresponding disks, respectively. A driving shaft of a generator or the like is coupled to an end of the rotor that is adjacent to the exhaust chamber.

The gas turbine does not have a reciprocating component such as a piston of a four-stroke engine. Therefore, mutual friction parts such as a piston-and-cylinder are not present, so that there are advantages in that there is little consumption of lubricant, the amplitude of vibration is markedly reduced unlike a reciprocating machine having high-amplitude characteristics, and high-speed driving is possible.

A brief description of the operation of the gas turbine is as follows. Air compressed by the compressor is mixed with fuel, the fuel mixture is combusted to generate high-temperature combustion gas, and the generated combustion gas is discharged to the turbine. The discharged combustion gas passes through the turbine vanes and the turbine blades and generates rotating force, by which the rotor is rotated.

Here, each turbine blade includes a root coupled to a turbine rotor disk, a turbine blade part or airfoil with which high-temperature combustion gas collides, and a platform connected between the root and the airfoil. In addition, an angel wing extends outward from each of opposite sides of the platform so as to seal space between the airfoil and the turbine rotor disk.

In the turbine blade according to a conventional technique, the root, the airfoil, the platform, and the angel wings are integrally formed through a casting process. However, there is a problem in that the castability reduces due to the angel wings that protrude sideways from the root. Particularly, since the angel wings are integrally formed with the root by casting, it is difficult to adjust a clearance between the airfoil and the turbine rotor disk such that the space between the airfoil and the turbine rotor disk is reliably sealed by the angel wings when the turbine blade is mounted to the turbine rotor disk. In addition, if an angel wing is damaged, the entirety of the turbine blade must be replaced with a new one. Hence, the maintenance cost is increased.

A technique related to the conventional turbine blade was proposed in Korean Utility Model Registration No. 10-0901905 (Jun. 10, 2009).

SUMMARY OF THE DISCLOSURE

Various embodiments of the present disclosure are directed to a turbine blade capable of improving the castability and adjusting a clearance between an airfoil and a turbine rotor disk such that space between the airfoil and the turbine rotor disk can be reliably sealed, and a turbine and a gas turbine having the same.

In accordance with one aspect of the present disclosure, there is provide a turbine blade installed on a rotor disk of a turbine and configured to rotate the turbine by a force of flowing gas. The turbine blade may include a root configured to be coupled to the rotor disk; a platform integrally formed with an upper portion of the root, the platform having opposite sides respectively extending in an axial direction of the rotor disk; an airfoil integrally formed with an upper portion of the platform; and an angel wing configured to be removably coupled to each of the opposite sides of the platform. When coupled, the angel wing may protrude from the platform in the axial direction. The angel wing may include a distal end that is bent toward the airfoil.

In accordance with another aspect of the present disclosure, there is provided a turbine configured to pass combustion gas supplied from a combustor to generate a driving force. The turbine may include a housing; and a turbine section disposed in the housing, the turbine section including a plurality of turbine rotor disks, and a plurality of turbine blades coupled to an outer surface of each of the plurality of turbine rotor disks. Each turbine blade is consistent with the above turbine blade.

In accordance with another aspect of the present disclosure, a gas turbine may include a compressor configured to draw in air and compress the air; a combustor configured to generate combustion gas by combusting fuel and the compressed air; and the above turbine.

The turbine blade may further include a coupling protrusion formed on a first end of the angel wing; and a coupling recess corresponding to the coupling protrusion formed in each of the opposite sides of the platform. The coupling protrusion may include an insert guide and a locking arm extending from the insert guide, and the coupling recess may include an insert guide slot configured to receive the insert guide of the coupling protrusion, and a locking arm slot configured to receive the locking arm of the coupling protrusion.

The locking arm slot may be disposed between a first end of the insert guide slot and a second end of the insert guide slot based on a longitudinal direction of the insert guide slot and slantly extend toward the inside of the platform. The locking arm slot may be disposed between the first end of the insert guide slot and the second end of the insert guide slot based on the longitudinal direction of the insert guide slot and extend upward toward the inside of the platform and/or downward toward the inside of the platform.

The locking arm may extend from the insert guide of the coupling protrusion in at least one direction of a first direction parallel to a radial direction of the rotor disk and a second direction opposite to the first direction. The first direction may be upward with respect to the insert guide inserted in the insert guide slot, and the second direction may be downward with respect to the insert guide inserted in the insert guide slot. Further, the locking arm may have a polygonal cross-sectional shape, and may extend from the insert guide at a slant relative to a longitudinal direction of the insert guide.

In a turbine blade, a turbine and a gas turbine having the same according to the present disclosure, an angel wing is removably coupled to each of opposite sides of a platform by a coupling protrusion and a coupling recess that correspond to each other. Consequently, an operation of integrally forming the platform, a root, and an airfoil through a casting process is facilitated. Furthermore, by replacement and installation of each angel wing on the platform, a clearance between the airfoil and the turbine rotor disk may be adjusted so that space between the airfoil and the turbine rotor disk is reliably sealed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF EMBODIMENTS

Hereinafter, embodiments of a turbine in accordance with the present disclosure will be described with reference to the accompanying drawings.

Figure 1:
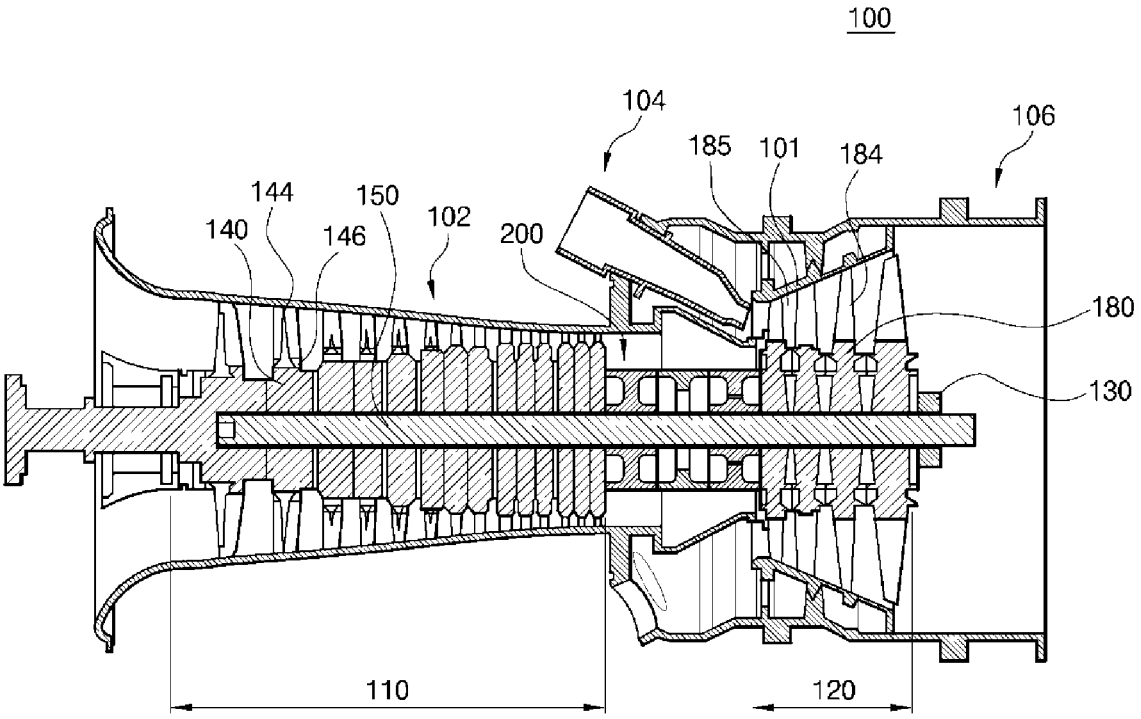
FIG. 1 is a sectional view illustrating a schematic structure of a gas turbine to which a turbine blade in accordance with an embodiment of the present disclosure is applied.

Referring to FIG. 1, there is illustrated an embodiment of a gas turbine 100 in accordance with the present disclosure. The gas turbine 100 includes a housing 102. A diffuser 106, through which combustion gas that has passed through a turbine is discharged, is provided on a read side of the housing 102. A combustor 104, which receives air compressed in a compressor section 110 of a compressor and combusts the air, is disposed ahead of the diffuser 106.

Based on a flow direction of air, the compressor section 110 is disposed at an upstream side of the housing 102, and a turbine section 120 is disposed at a downstream side. In addition, a torque tube 130 which is a torque transmission unit for transmitting rotational torque generated from the turbine section 120 to the compressor section 110 is disposed between the compressor section 110 and the turbine section 120.

The compressor section 110 is provided with a plurality (e.g., fourteen sheets) of compressor rotor disks 140. The compressor rotor disks 140 are coupled by a tie rod 150 such that they are not spaced apart from each other in an axial direction.

In detail, the compressor rotor disks 140 are arranged along the axial direction of the tie rod 150 passing through respective approximately central portions of the compressor rotor disks 140. Here, facing surfaces of neighboring compressor rotor disks 140 are compressed onto each other by the tie rod 150, whereby the compressor rotor disks 140 cannot rotate relative to each other.

A plurality of compressor blades 144 are radially coupled to an outer circumferential surface of each compressor rotor disk 140. Each of the compressor blades 144 includes a root 146 by which the compressor blade 144 is coupled to the compressor rotor disk 140.

Vanes (not shown) fixed to the housing 102 are disposed between the compressor rotor disks 140. The vanes are fixed not to be rotated unlike the compressor rotor disks 140. Each vane functions to align the flow of compressed air that has passed through the compressor blades 144 of the compressor rotor disk 140 disposed at an upstream side, and guide the compressed air to the compressor blades 144 of the compressor rotor disk 140 disposed at a downstream side.

A coupling scheme of the root 146 is classified into a tangential type and an axial type. This may be selected depending on a needed structure of the gas turbine to be used, and may be embodied in a well-known dovetail or fir-tree type structure. In some cases, the compressor blade 144 may be coupled to the compressor rotor disk 140 by using a separate coupling device, e.g., a fastener such as a key or a bolt, other than the above-mentioned coupling scheme.

The tie rod 150 is disposed passing through central portions of the plurality of compressor rotor disks 140. One end of the tie rod 150 is coupled to the compressor rotor disk 140 that is disposed at the most upstream side, and the other end thereof is fixed in the torque tube 130.

The shape of the tie rod 150 is not limited to the shape proposed in FIG. 1 because it may have various structures depending on the structure of the gas turbine. In other words, as shown in the drawing, a single tie rod 150 may be configured in such a way that it passes through the central portions of the compressor rotor disks 140, a plurality of tie rods 150 may be arranged in a circumferential direction, or a combination thereof is also possible.

Although not shown, a vane functioning as a guide vane may be installed in the compressor of the gas turbine at a position following the diffuser so as to adjust a flow angle of fluid to a designed flow angle, the fluid entering an entrance of the combustor after the pressure of the fluid has been increased. This vane is referred to as a deswirler.

The combustor 104 mixes introduced compressed air with fuel, combusts the fuel mixture to generate high-temperature and high-pressure combustion gas having high energy, and increases, through an isobaric combustion process, the temperature of the combustion gas to a heat resistant limit temperature at which the parts of the combustor and the turbine can endure.

A combustion system of the gas turbine may include a plurality of combustors 104 arranged in a casing formed in a cell shape. Each of the combustors 104 includes a burner including a fuel injection nozzle, etc., a combustor liner forming a combustion chamber, and a transition piece serving as a connector between the combustor and the turbine.

In detail, the liner provides a combustion space in which fuel discharged from the fuel injection nozzle is mixed with compressed air supplied from the compressor and then combusted. The liner may include a flame tube for providing the combustion space in which the fuel mixed with air is combusted, and a flow sleeve for forming an annular space enclosing the flame tube. The fuel injection nozzle is coupled to a front end of the liner, and an ignition plug is coupled to a sidewall of the liner.

The transition piece is connected to a rear end of the liner so as to transfer combustion gas combusted by the ignition plug toward the turbine. An outer wall of the transition piece is cooled by compressed air supplied from the compressor so as to prevent the transition piece from being damaged by high-temperature combustion gas.

To this end, the transition piece has cooling holes through which air can be injected into an internal space of the transition piece. Compressed air cools a main body in the transition piece through the cooling holes and then flows toward the liner.

The cooling air that has cooled the transition piece may flow through the annular space of the liner. Compressed air may be provided as cooling air from the outside of the flow sleeve through cooling holes provided in the flow sleeve, and collide with an outer wall of the liner.

On the one hand, high-temperature and high-pressure combustion gas that has come out of the combustor is supplied into the above-described turbine section 120. The supplied high-temperature and high-pressure combustion gas expands and collides with an impeller of the turbine so that reaction force is generated in the turbine, thus inducing rotational torque. The obtained rotational torque is transmitted to the compressor section 110 via the torque tube. Power that exceeds power needed to drive the compressor is used to drive the generator, etc.

The turbine section 120 basically has a structure similar to that of the compressor section 110. In detail, the turbine section 120 includes a plurality of turbine rotor disks 180 similar to the compressor rotor disks 140 of the compressor section 110. Each turbine rotor disk 180 also includes a plurality of turbine blades 184 which are radially disposed. Each turbine blade 184 may also be coupled to the turbine rotor disk 180 in a dovetail coupling manner or the like. In addition, vanes 185 fixed to the housing 101 of the turbine section 120 are provided between the turbine blades 184 of the turbine rotor disks 180 so as to guide the flow direction of combustion gas that passes through the turbine blades 184.

Figure 2:
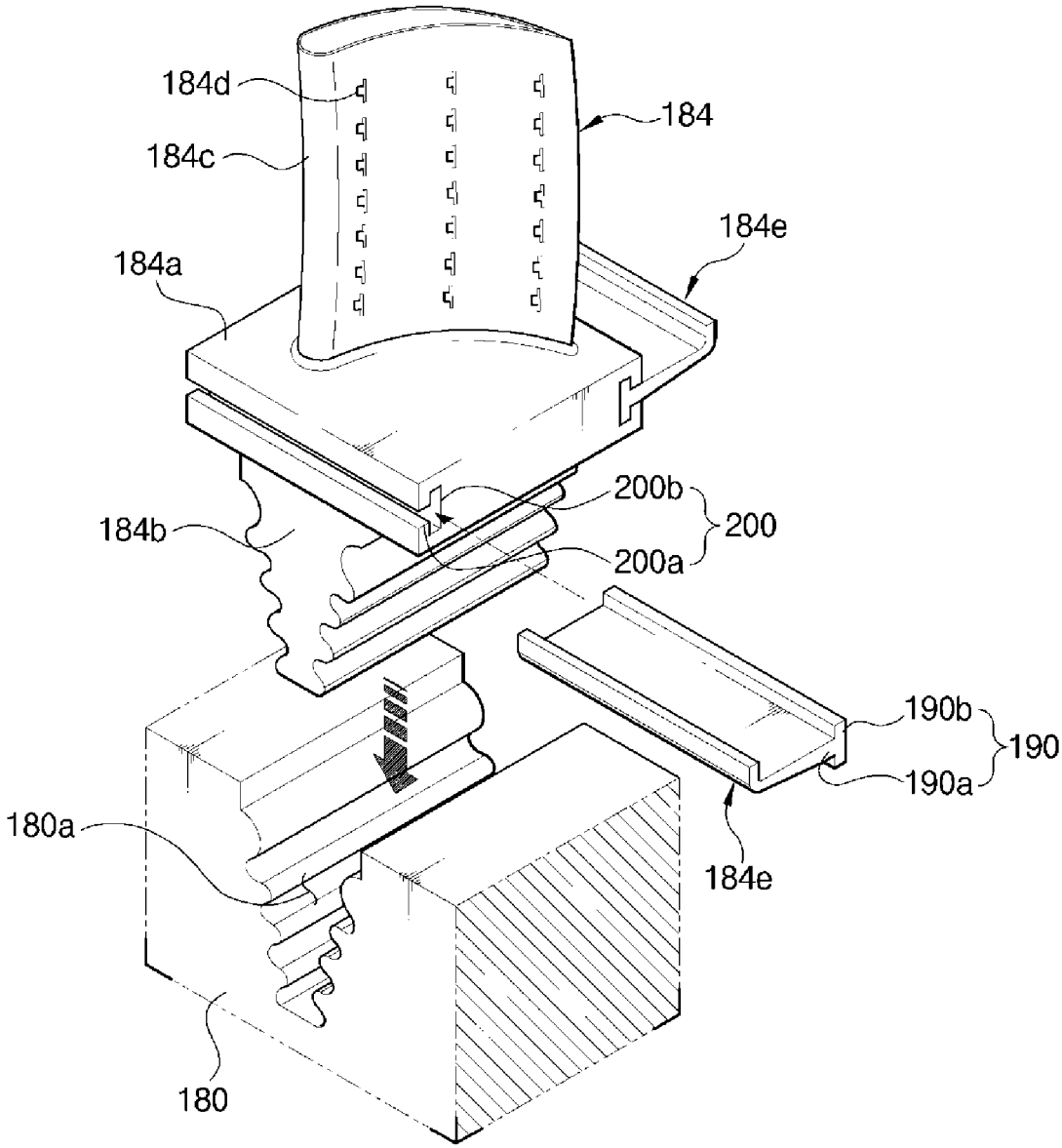
FIG. 2 is an exploded perspective view of a turbine blade and a portion of a turbine rotor disk shown in FIG. 1.

Referring to FIG. 2, illustrating a turbine blade 184 and a portion of one of the turbine rotor disks 180 of the turbine section 120, the turbine blade 184 is coupled to the turbine rotor disk 180 using a coupling slot 180*a*. A plurality of coupling slots 180*a* are formed in an outer circumferential surface of the turbine rotor disk 180 to extend in an axial direction of the turbine rotor disk 180, which has an approximately circular plate shape. Each coupling slot 180*a* is a corrugated surface having a fir-tree shape or similar configuration for coupling with the turbine blade 184.

According to an embodiment of the present disclosure, the turbine blade 184 includes a root 184 configured to be coupled to the turbine rotor disk 180; a platform 184*a* integrally formed with an upper portion of the root 184; an airfoil 184*c* integrally formed with an upper portion of the platform 184*a;* and a pair of angel wings configured to be removably coupled to the platform 184, which has opposite sides respectively extending in the axial direction of the turbine rotor disk 180.

As shown in FIG. 2, the platform 184*a* is formed approximately in the overall enter of the turbine blade 184, radially speaking, and has a generally planar shape. In addition to the opposite sides which extend axially, the platform 184*a* has opposite side surfaces arranged to face a neighboring turbine blade 184. That is, the platform 184*a* has a side surface which comes into contact with a corresponding side surface of the platform 184*a* of a neighboring turbine blade 184, thus functioning to maintain an interval between adjacent turbine blades 184.

The root 184*b* is provided under a lower surface of the platform 184*a*. The root 184*b* has a so-called axial-type structure, such that the root 184*b* is inserted into the coupling slot 180*a* of the turbine rotor disk 180 along the axial direction of the turbine rotor disk 180. The root 184*b* has is a corrugated surface having a fir-tree shape or similar configuration corresponding to the configuration of the coupling slot 180*a*. Here, the coupling structure of the root 184*b* is not limited to a fir-tree shape, and may be formed to have a dovetail structure.

The airfoil 184*c* is provided on an upper surface of the platform 184*a* and is formed to have an optimized profile according to specifications of the gas turbine. That is, the airfoil 184*c* includes a leading edge disposed on the upstream side of the turbine blade 184, with respect to the combustion gas flow direction, and a trailing edge disposed on the downstream side.

Here, unlike the compressor blade 144 of the compressor section 110, the turbine blade 184 of the turbine section 120 comes into direct contact with high-temperature and high-pressure combustion gas. Since combustion gas has a high temperature reaching 1700° C., a cooling method is required. To this end, the gas turbine includes a cooling passage through which compressed air drawn from the compressor section 110 is supplied to the turbine blades 184 of the turbine section 120. The cooling passage may include one or both of an external passage extending outside the housing 101 and an internal passage extending through the interior of the rotor disk. As shown in FIG. 2, a plurality of film cooling holes 184*d* are formed in a surface of the airfoil 184*c* and communicate with a cooling passage (not shown) formed in the airfoil 184*c* in order to supply cooling air to the surface of the airfoil 184*c*.

Furthermore, each of the pair of angel wings 184*e* is coupled to the axially arranged opposite sides of the platform 184*a* in such a way that the angel wings 184*e* protrude outward in opposite side directions of the platform 184*a*. The angel wings 184*e* function to seal space between the airfoil 184*c* and the turbine rotor disk 180 so that high-temperature and high-pressure combustion gas colliding with the airfoil 184*c* can be prevented from being drawn into the turbine rotor disk 180.

The angel wings 184*e* are respectively coupled to the opposite side surfaces of the platform 184*a*. Here, the angel wings 184*e* may be provided in a single- or multi-stage structure on the respective opposite side surfaces of the platform 184*a*. In the case where the angel wings 184*e* may be provided in the multi-stage structure on the respective opposite side surfaces of the platform 184*a,* the sealing between the airfoil 184*c* and the turbine rotor disk 180 may be more reliably embodied.

A first end, i.e., a first side, of each angel wing 184*e* that is coupled to the platform 184*a* is removably coupled to a corresponding one of the opposite side surfaces of the platform 184*a*. As such, in the case where the angel wings 184*e* are removably coupled to the respective opposite side surfaces of the platform 184*a*, a process of integrally casting the platform 184*a*, the root 184*b*, and the airfoil 184*c* that are parts of the turbine blade 184 other than the angel wings 184*e* may be facilitated. Furthermore, the structure capable of removably coupling the angel wings 184*e* to the respective opposite side surfaces of the platform 184*a* makes it possible to replace the angel wings 184*e* with other ones such that a clearance between the airfoil 184*c* and the turbine rotor disk 180 is reduced. Here, a second side edge 184*f* of each angel wing 184*e* may be a distal end that is bent toward the airfoil 184*c*, i.e., radially upward, but it is not limited thereto, and, for example, it may have a planar shape.

Each angel wing 184*e* and the platform 184*a* may be removably coupled to each other by a coupling protrusion 190 and a coupling recess 200 which are coupled correspondingly to each other. In other words, the coupling protrusion 190 is provided on the first side edge of the angel wing 184*e*. The coupling recess 200 is formed in each of the opposite side surfaces of the platform 184*a*. Here, the coupling recess 200 is formed extending from a front surface of the platform 184*a* to a rear surface so as to allow the coupling protrusion 190 from being inserted and coupled into the coupling recess 200 from the front or rear surface of the platform 184*a* in a sliding manner.

The coupling recess 200 includes an insert guide slot 200*a* which is depressed from each of the opposite side surfaces of the platform 184*a* toward an inside of the platform 184*a*, and a locking arm slot 200*b* which extends, based on a longitudinal direction of the insert guide slot 200*a*, from an inner end of the insert guide slot 200*a* toward the inside of the platform 184*a*.

The coupling protrusion 190 includes an insert guide 190*a* which extends from the first side edge of the angel wing 184*e* and is inserted correspondingly into the insert guide slot 200*a*, and a locking arm 190*b* which extends from an end of the insert guide 190*a* and is inserted correspondingly into the locking arm slot 200*b*.

Here, the locking arm slot 200*b* of the coupling recess 200 extends from the inner end of the insert guide slot 200*a*, i.e., a first longitudinal end of the insert guide slot 200*a*, at a predetermined inclined angle based on the longitudinal direction of the insert guide slot 200*a*. Therefore, after the locking arm 190*b* of the coupling protrusion 190 is inserted correspondingly into the locking arm slot 200*b*, the coupled state can be maintained such that the angel wing 184*e* is prevented from being undesirably removed in the opposite side directions of the platform 184*a*. Here, although it is preferable that the locking arm slot 200*b* be extended perpendicular to the first longitudinal end of the insert guide slot 200*a* based on the longitudinal direction of the insert guide slot 200*a*, the present disclosure is not limited thereto. For example, the locking arm slot 200*b* may be inclined at various angles from the first longitudinal end of the insert guide slot 200*a*. In this case, the locking arm 190*b* of the coupling protrusion 190 slantly extends from the end of the insert guide 190*a*. In other words, the locking arm 190*b* extends from the end of the insert guide 190*a* at a predetermined inclined angle based on the longitudinal direction of the insert guide 190*a* so that the locking arm 190*b* can be inserted correspondingly into the locking arm slot 200*b*.

Figure 3:
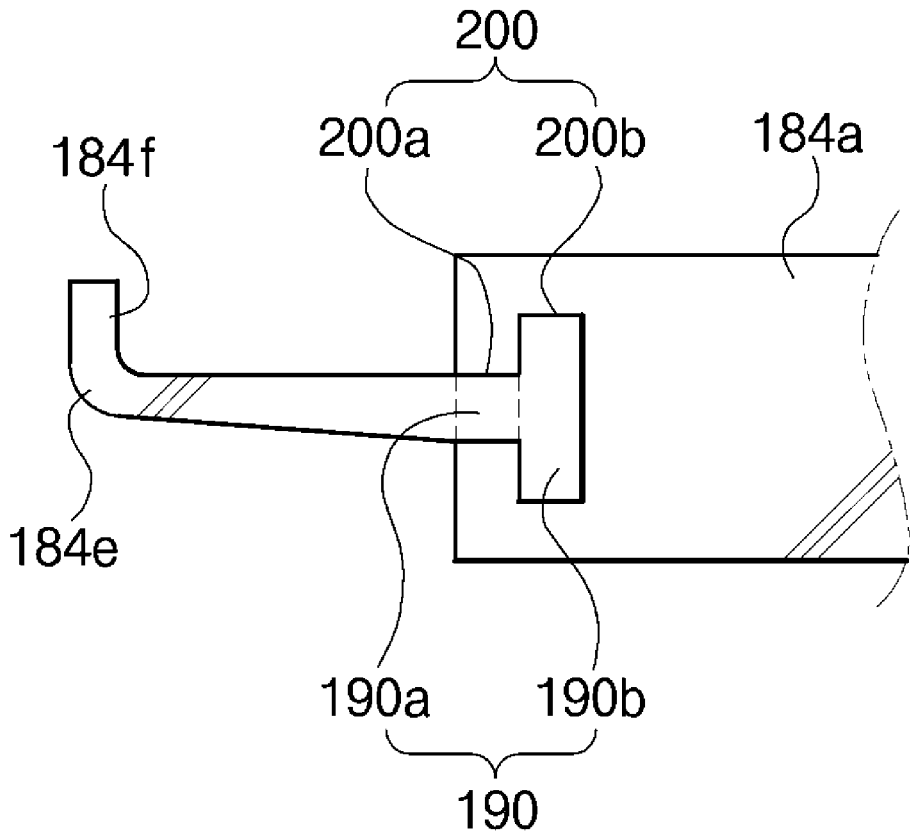
FIG. 3 is a cross-sectional view of a portion of the turbine blade of FIG. 2, illustrating a coupling of an angel wing with a platform in accordance with an embodiment of the present disclosure.

Referring to FIG. 3, the locking arm slot 200*b* may extend upward and downward toward the inside of the platform 184*a* from the first longitudinal end of the insert guide slot 200*a* based on the longitudinal direction of the insert guide slot 200*a*. In this case, the locking arm 190*b* extends upward and downward from the end of the insert guide 190*a* so that the locking arm 190*b* can be inserted correspondingly into the locking arm slot 200*b*.

Figure 4:
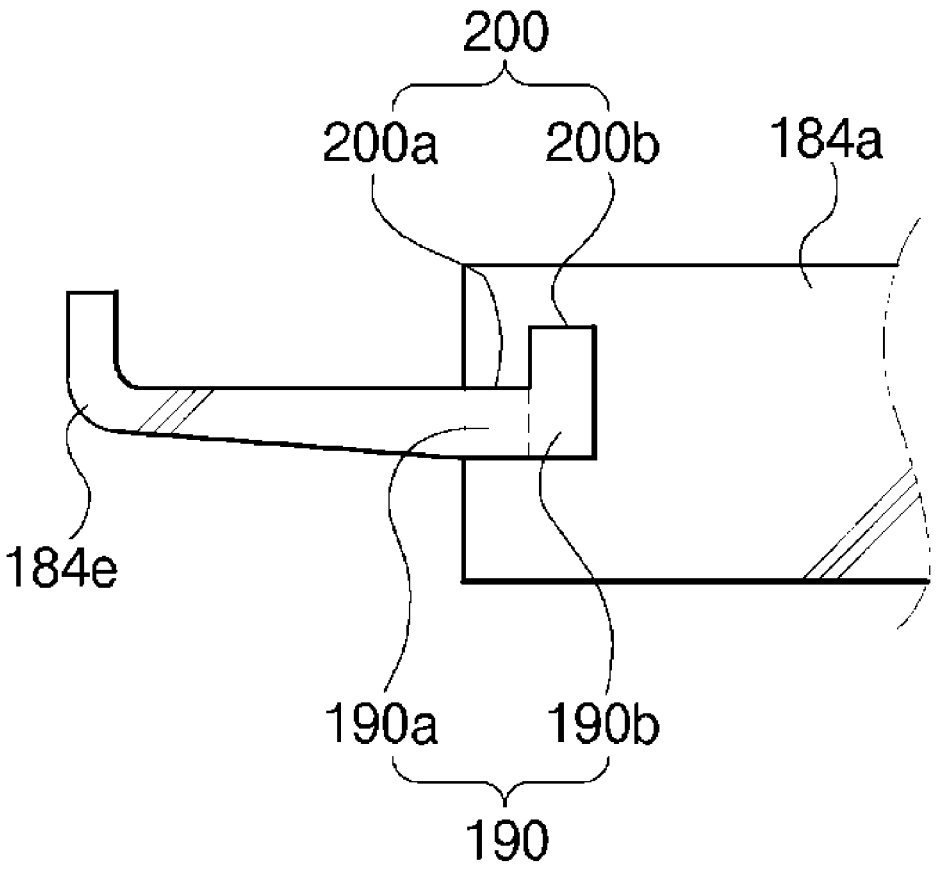
FIGS. 4 to 8 are cross-sectional views of a portion of the turbine blade of FIG. 2, respectively illustrating a coupling of an angel wing with a platform in accordance with further embodiments of the present disclosure.
Figure 5:
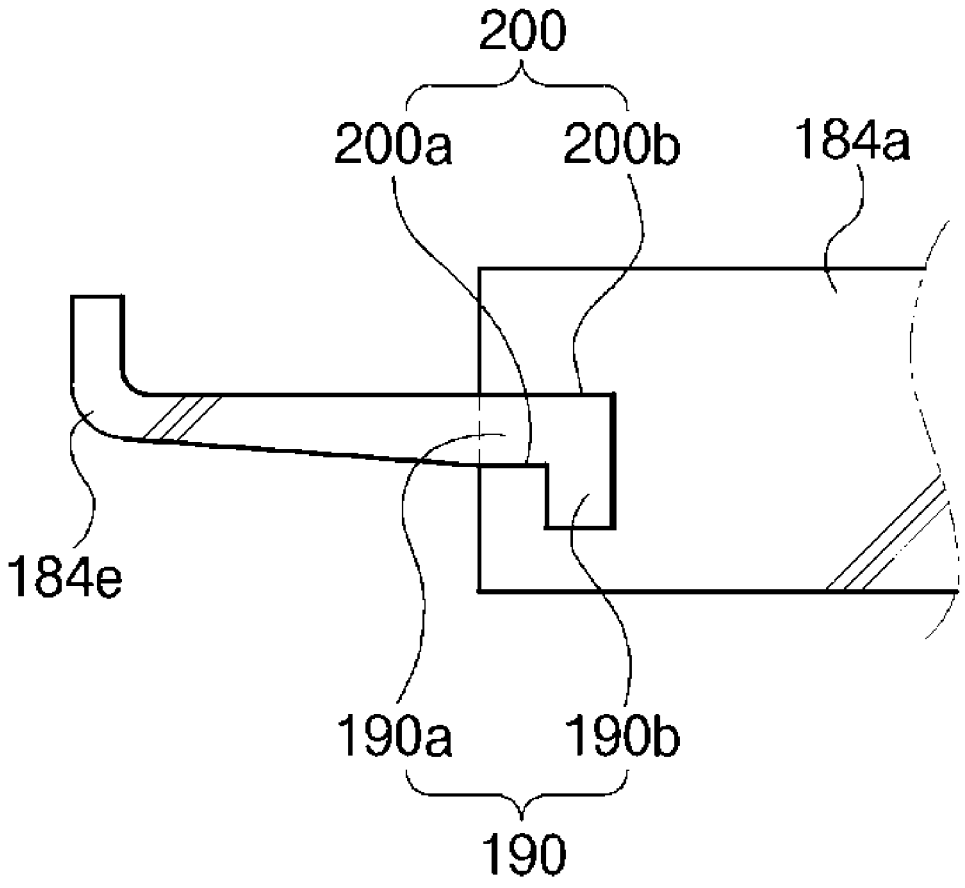

Alternatively, as shown in FIGS. 4 and 5, the locking arm slot 200*b* may extend only upward toward the inside of the platform 184*a* from the first longitudinal end of the insert guide slot 200*a* based on the longitudinal direction of the insert guide slot 200*a*, or may extend only downward toward the inside of the platform 184*a* from the first longitudinal end of the insert guide slot 200*a*. In this case, the locking arm 190*b* extends upward or downward from the end of the insert guide 190*a* so that the locking arm 190*b* can be inserted correspondingly into the locking arm slot 200*b*.

Figure 6:
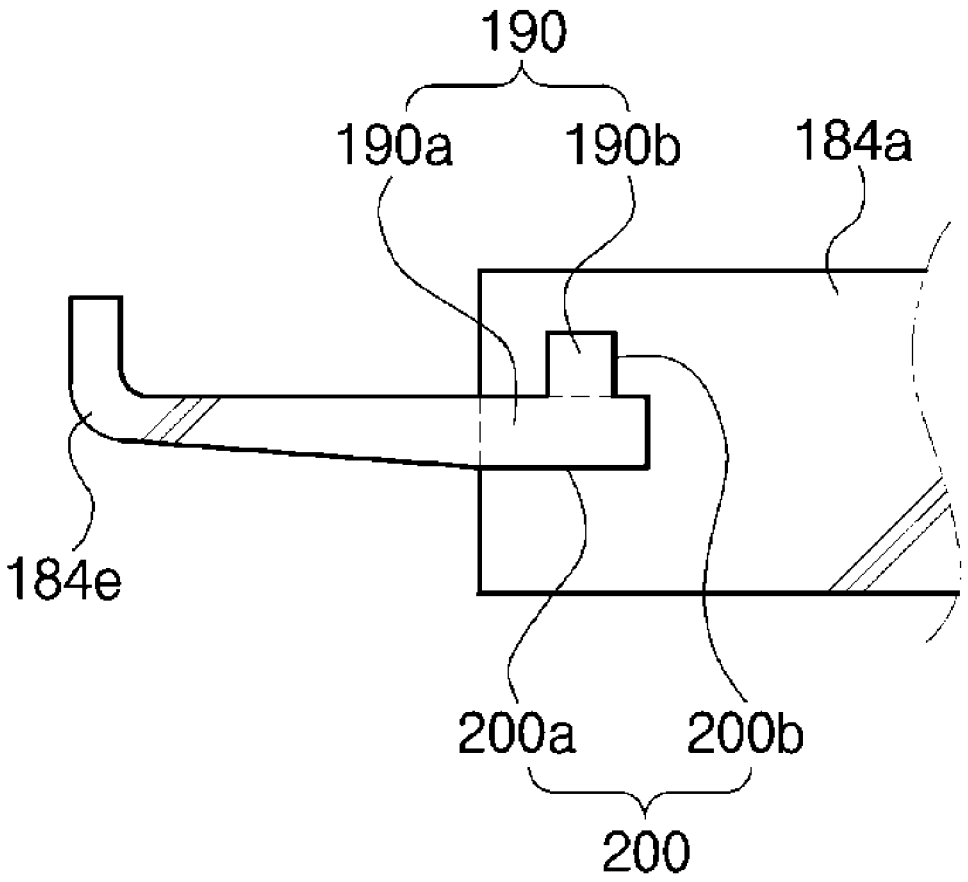
Figure 7:
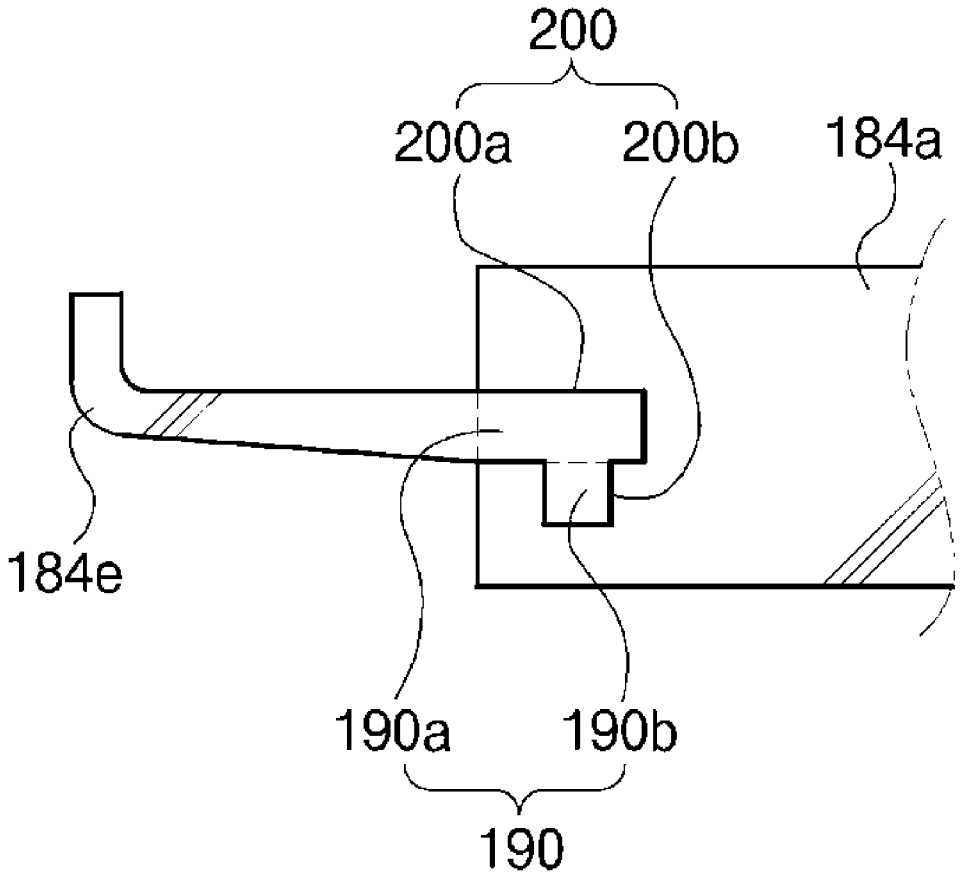
Figure 8:
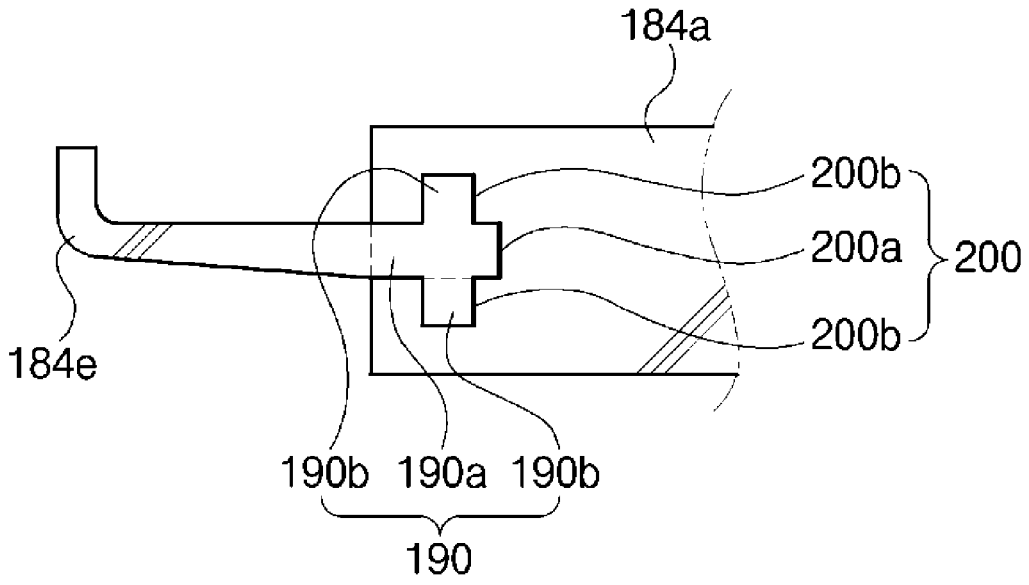

As a further alternative, as shown in FIGS. 6 to 8, the locking arm slot 200*b* may be disposed between the first longitudinal end of the insert guide slot 200*a* and a second longitudinal end of the insert guide slot 200*a* based on the longitudinal direction of the insert guide slot 200*a* and extend at an inclined angle toward the inside of the platform 184*a*. Here, although it is preferable that the locking arm slot 200*b* be disposed between the first longitudinal end of the insert guide slot 200*a* and the second longitudinal end of the insert guide slot 200*a* and extend in a direction perpendicular to the insert guide slot 200*a*, the present disclosure is not limited thereto. For example, the locking arm slot 200*b* may be inclined at various angles from the insert guide slot 200*a* based on the longitudinal direction of the insert guide slot 200*a*. In these cases, the locking arm 190*b* of the coupling protrusion 190 may extend at an inclined angle from a portion of an upper surface or a portion of a lower surface of the insert guide 190*a* or each of the upper and lower surfaces of the insert guide 190*a*. In other words, the locking arm 190*b* extends from the upper or lower surface of the insert guide 190*a* or each of the upper and lower surfaces of the insert guide 190*a* at a predetermined inclined angle based on the longitudinal direction of the insert guide 190*a* so that the locking arm 190*b* can be inserted correspondingly into the locking arm slot 200*b*.

That is, referring to FIG. 6, the locking arm slot 200*b* may be disposed between the first longitudinal end of the insert guide slot 200*a* and the second longitudinal end of the insert guide slot 200*a* based on the longitudinal direction of the insert guide slot 200*a* and extend upward toward the inside of the platform 184*a*. In this case, the locking arm 190*b* extends upward from a predetermined portion of the upper surface of the insert guide 190*a* so that the locking arm 190*b* can be inserted correspondingly into the locking arm slot 200*b*.

Alternatively, referring to FIG. 7, the locking arm slot 200*b* may be disposed between the first longitudinal end of the insert guide slot 200*a* and the second longitudinal end of the insert guide slot 200*a* based on the longitudinal direction of the insert guide slot 200*a* and extend downward toward the inside of the platform 184*a*. In this case, the locking arm 190*b* extends downward from a predetermined portion of the lower surface of the insert guide 190*a* so that the locking arm 190*b* can be inserted correspondingly into the locking arm slot 200*b*.

As a further alternative, referring to FIG. 8, the locking arm slot 200*b* may be disposed between the first longitudinal end of the insert guide slot 200*a* and the second longitudinal end of the insert guide slot 200*a* based on the longitudinal direction of the insert guide slot 200*a* and extend in each of the upward and downward directions toward the inside of the platform 184*a*. In this case, the locking arm 190*b* extends both upward from a predetermined portion of the upper surface of the insert guide 190*a* and downward from a predetermined portion of the lower surface of the insert guide 190*a* so that the locking arm 190*b* can be inserted correspondingly into the locking arm slot 200*b*.

Here, although each of the locking arm slot 200*b* and the locking arm 190*a* is illustrated as having a polygonal cross-sectional shape, the present disclosure is not limited thereto. For example, each of the locking arm slot 200*b* and the locking arm 190*a* may have a semi-circular or circular cross-sectional shape such that, when the locking coupling is embodied by the locking arm 190*a* and the locking arm slot 200*b*, reliable fastening force can be transmitted from the inside of the platform 184*a*.

As described above, in the turbine blade, the turbine and the gas turbine having the same in accordance with the embodiments of the present disclosure, the angel wings 184*e* are removably coupled to the respective opposite sides of the platform 184*a* by the coupling protrusion 190 and the coupling recess 200 that correspond to each other. Consequently, an operation of integrally forming the platform 184*a*, the root 184*b*, and the airfoil 184*c* through a casting process is facilitated. Furthermore, by replacement and installation of each angel wing 184*e* on the platform 184*a*, a clearance between the airfoil 184*c* and the turbine rotor disk 180 may be adjusted so that space between the airfoil 184*c* and the turbine rotor disk 180 is reliably sealed.

While the present disclosure has been described with respect to the specific embodiments, it will be apparent to those skilled in the art that various changes and modifications may be made without departing from the spirit and scope of the disclosure as defined in the following claims.

What is claimed is:

1. A turbine blade installed on a rotor disk of a turbine and configured to rotate the turbine by a force of flowing gas, the turbine blade comprising:

a root configured to be coupled to the rotor disk;

a platform integrally formed with an upper portion of the root, the platform having opposite sides respectively extending in an axial direction of the rotor disk;

an airfoil integrally formed with an upper portion of the platform; and an angel wing configured to be removably coupled to at least one of the opposite sides of the platform;

wherein the coupled angel wing protrudes from the platform in the axial direction.

2. The turbine blade according to claim 1, further comprising: a coupling protrusion formed on a first end of the angel wing; and a coupling recess corresponding to the coupling protrusion formed in each of the opposite sides of the platform.

3. The turbine blade according to claim 2, wherein the coupling protrusion comprises an insert guide and a locking arm extending from the insert guide, and wherein the coupling recess comprises an insert guide slot configured to receive the insert guide of the coupling protrusion, and a locking arm slot configured to receive the locking arm of the coupling protrusion.

4. The turbine blade according to claim 3, wherein the locking arm slot is disposed between a first end of the insert guide slot and a second end of the insert guide slot based on a longitudinal direction of the insert guide slot and slantly extends toward the inside of the platform.

5. The turbine blade according to claim 4, wherein the locking arm slot is disposed between the first end of the insert guide slot and the second end of the insert guide slot based on the longitudinal direction of the insert guide slot and extends upward toward the inside of the platform or downward toward the inside of the platform.

6. The turbine blade according to claim 4, wherein the locking arm slot is disposed between the first end of the insert guide slot and the second end of the insert guide slot based on the longitudinal direction of the insert guide slot and extends upward toward the inside of the platform and downward toward the inside of the platform.

7. The turbine blade according to claim 3, wherein the locking arm extends from the insert guide of the coupling protrusion in one direction of a first direction parallel to a radial direction of the rotor disk and a second direction opposite to the first direction.

8. The turbine blade according to claim 7, wherein the first direction is upward with respect to the insert guide inserted in the insert guide slot, and the second direction is downward with respect to the insert guide inserted in the insert guide slot.

9. The turbine blade according to claim 3, wherein the locking arm has a polygonal cross-sectional shape.

10. The turbine blade according to claim 3, wherein the locking arm extends from the insert guide at a slant relative to a longitudinal direction of the insert guide.

11. The turbine blade according to claim 3, wherein the locking arm extends from the insert guide of the coupling protrusion in both a first direction parallel to a radial direction of the rotor disk and a second direction opposite to the first direction.

12. The turbine blade according to claim 11, wherein the first direction is upward with respect to the insert guide inserted in the insert guide slot, and the second direction is downward with respect to the insert guide inserted in the insert guide slot.

13. The turbine blade according to claim 1, wherein the angel wing comprises a distal end that is bent toward the airfoil.

14. A turbine configured to pass combustion gas supplied from a combustor to generate a driving force, the turbine comprising:

a housing, a turbine section disposed in the housing, the turbine section including a plurality of turbine rotor disks, and a plurality of turbine blades coupled to an outer surface of each of the plurality of turbine rotor disks, each turbine blade comprising:

a root configured to be coupled to the rotor disk;

a platform integrally formed with an upper portion of the root, the platform having opposite sides respectively extending in an axial direction of the rotor disk;

an airfoil integrally formed with an upper portion of the platform; and an angel wing configured to be removably coupled to at least one of the opposite sides of the platform;

wherein the coupled angel wing protrudes from the platform in the axial direction.

15. The turbine according to claim 14, wherein each turbine blade further comprises: a coupling protrusion formed on a first end of the angel wing; and a coupling recess corresponding to the coupling protrusion formed in each of the opposite sides of the platform.

16. The turbine according to claim 15, wherein the coupling protrusion comprises an insert guide and a locking arm extending from the insert guide, and wherein the coupling recess comprises an insert guide slot configured to receive the insert guide of the coupling protrusion, and a locking arm slot configured to receive the locking arm of the coupling protrusion.

17. The turbine according to claim 16, wherein the locking arm extends from the insert guide of the coupling protrusion in at least one direction of a first direction parallel to a radial direction of the rotor disk and a second direction opposite to the first direction.

18. A gas turbine comprising:

a compressor configured to draw in air and compress the air;

a combustor configured to generate combustion gas by combusting fuel and the compressed air; and a turbine configured to pass combustion gas supplied from a combustor to generate a driving force, the turbine comprising:

a housing, a turbine section disposed in the housing, the turbine section including a plurality of turbine rotor disks, and a plurality of turbine blades coupled to an outer surface of each of the plurality of turbine rotor disks, each turbine blade comprising a root configured to be coupled to the rotor disk;

a platform integrally formed with an upper portion of the root, the platform having opposite sides respectively extending in an axial direction of the rotor disk;

an airfoil integrally formed with an upper portion of the platform; and an angel wing configured to be removably coupled to at least one of the opposite sides of the platform;

wherein the coupled angel wing protrudes from the platform in the axial direction.

* * * * *